US006752277B1

(12) United States Patent
Sempliner

(10) Patent No.: US 6,752,277 B1
(45) Date of Patent: Jun. 22, 2004

(54) PRODUCT DISPLAY SYSTEM USING RADIO FREQUENCY IDENTIFICATION

(75) Inventor: Arthur T. Sempliner, Douglaston, NY (US)

(73) Assignee: Masters of Branding, Inc., New York, NY (US)

( * ) Notice: Subject to any disclaimer, the term of this patent is extended or adjusted under 35 U.S.C. 154(b) by 0 days.

(21) Appl. No.: 10/223,879

(22) Filed: Aug. 20, 2002

(51) Int. Cl.[7] ..... A47F 7/00

(52) U.S. Cl. ..... 211/59.3; 211/1.57; 211/183; 211/121

(58) Field of Search ..... 211/59.3, 59.2, 211/59.4, 1.51, 121, 1.57, 183; 312/61, 71, 42, 97, 35

(56) References Cited

U.S. PATENT DOCUMENTS

| | | | | |
|---|---|---|---|---|
| 5,110,192 A | | 5/1992 | Lauterbach | |
| 5,444,223 A | | 8/1995 | Blama | |
| 5,605,237 A | * | 2/1997 | Richardson et al. | 211/59.3 |
| 5,685,664 A | * | 11/1997 | Parham et al. | 403/393 |
| 5,730,320 A | * | 3/1998 | David | 221/279 |
| 5,873,489 A | * | 2/1999 | Ide et al. | 221/279 |
| 6,025,780 A | | 2/2000 | Bowers et al. | |
| 6,253,954 B1 | * | 7/2001 | Yasaka | 221/93 |
| 6,377,176 B1 | | 4/2002 | Lee | |
| 6,382,431 B1 | * | 5/2002 | Burke | 211/59.3 |
| 6,409,027 B1 | * | 6/2002 | Chang et al. | 211/59.3 |
| 6,464,089 B1 | * | 10/2002 | Rankin, VI | 211/59.3 |
| 2002/0170866 A1 | * | 11/2002 | Johnson et al. | 211/59.3 |
| 2002/0190845 A1 | * | 12/2002 | Moore | 340/10.3 |
| 2003/0063396 A1 | * | 4/2003 | Chirnomas | 414/626 |

FOREIGN PATENT DOCUMENTS

| | | |
|---|---|---|
| FR | 2 526 338 | 5/1982 |

* cited by examiner

*Primary Examiner*—Jennifer E. Novosad
(74) *Attorney, Agent, or Firm*—Schweitzer Cornman Gross & Bondell LLP

(57) ABSTRACT

A system for the display and distribution of multiple product items, where the product items bear radio frequency identification (RFID) tags, and an RFID reader is associated in close proximity for maintaining effectively continuous inventory control. A product display tray is provided with multiple product channels and individual pusher sleds in the product channels for urging the product items to the front of the display. The pusher sleds are actuated by non-metallic tension elements extending underneath the product items in conjunction with spring-actuated windup reels for maintaining the tension elements under tension urging the sleds in the desired direction. An RFID reader board is disposed directly under the product display tray, arranged for periodic reading of the entire contents of the tray. The non-metallic tension elements, extending underneath the product items, provide for actuation of the pusher sleds without interfering with the radio frequency identification procedures.

14 Claims, 7 Drawing Sheets

PRODUCT DISPLAY SYSTEM USING RADIO FREQUENCY IDENTIFICATION

BACKGROUND OF THE INVENTION

Radio frequency identification (RFID) is finding increasing application to inventory and point-of-purchase control for products that are mass merchandised. In large chain store systems, product suppliers typically are allotted a very specific shelf or wall area in individual stores of the chain. Typically, substantial sums of money are required to be paid by the suppliers for the allotment of such shelf or wall space for the display of the supplier's product. Because of the significant costs involved, and the limited space available, suppliers devote considerable time and effort to the design of the planograms for their product space, seeking to achieve maximum product sales from the display space provided. In many cases, the manufacturers visit the individual stores on a regular basis to review the state of their planogram, and make certain that merchandise is displayed where it is supposed to be displayed, and that there are adequate quantities of each product.

RFID procedures can be employed to advantage in managing and monitoring such product displays on a remote basis, minimizing the need for personal visitations by manufacturer's representatives. Using RFID systems, each product item can be provided with an individual identification tag, which is specific not only to the class of product, but even individual to each particular product item within the class. A radio frequency reader element is associated with the product display, and is activated periodically, for example as frequently as twice a minute. When the reader is in operation, the identification tag of each product item within range of the reader is activated and returns its unique identification code to the reader, which can then transmit the information to any of various remote locations, enabling the supplier to know on a substantially continuous basis which product items are selling and the rate of such sales. Additionally, the RFID information transmitted can also indicate when a particular product item has been misplaced in the planogram, as frequently occurs when a prospective customer picks up an item for inspection and replaces it in a different location. The technology for such RFID inventory management systems is well known to those in the art.

Many products are preferentially displayed in columns which extend on a shelf or wall mounted in a row from front to back. Pusher means are provided at the back of the product column, such that when a customer selects and removes a product item from the front of the display, the balance of the product column will be moved forward by the pusher element acting on the back of the column. Such pusher arrangements are well known and in widespread use in merchandise displays. Typically, however, such pusher arrangements have been incompatible with RFID inventory management techniques, because of the interference caused by the metal spring element of the pusher device.

SUMMARY OF INVENTION

Conventional, widely used pusher arrangements for product displays typically employ a coiled strip spring, anchored at its forward end, and having its coiled body confined within portions of a movable pusher sled arranged for back to front sliding movement to urge product items in a forward direction. When loading a column of product items, the sled is moved to a retracted position. During the retracting movement, the strip spring is progressively uncoiled and the uncoiled portions extend along the bottom of the display column, lying underneath the various product items positioned in front of the pusher sled. As product items are removed from the column, the spring recoils itself, advancing the sled and urging the remaining products in a forward direction.

Although pusher sleds as of the type described above are in widespread use, they create a problem in connection with RFID inventory control, because of the presence of the metal spring material directly under the products, typically in close adjacency to the RF identification tag, which is preferentially mounted on the bottom of the product.

Pursuant to one aspect of the present invention, a novel and improved product pusher arrangement is provided which accommodates and optimizes the ability to monitor product items in a pusher activated display, using RFID techniques. To this end, the pusher sled incorporates a spring-operated reel carrying a flexible tape or the like formed of a non-metallic material, such as nylon or other suitable plastic. The non-metallic tape, serving as a tension element, is arranged to underlie the monitored product items, when the sled is in a retracted position. The arrangement is such that, as the sled is retracted, the non-metallic tension element is withdrawn from the wheel, which is simultaneously being acted upon by a spring associated with the reel, preferably housed internally thereof. As the sled is retracted, and the tension element is withdrawn from the reel, the spring is correspondingly wound up, urging the reel to rotate in a direction to retract the tension element. Thus, in the system of the invention, the metallic return spring element is positioned entirely behind the front surface of the sled, so as to be offset from the displayed product items, allowing the items to be reliably activated and read by a radio frequency reader device.

In a preferred and advantageous form of the invention, a product display arrangement incorporates a tray with laterally spaced dividing walls forming a multiple column product display. Each column is provided with a pusher sled of the type described above, including a spring-driven reel mounted on the sled and carrying a non-metallic tension element for urging the sled toward the front of the display. A radio frequency reader board, operating on known RFID principles, is mounted underneath the divided tray, so as to be directly underneath the product items displayed thereon. To advantage, the reader is repetitively activated to read the contents of each channel and identify each product remaining therein. The non-metallic tension elements of the several pusher sleds enable the individual products to be accurately detected, such that essentially real time inventory information is available to the store and to the supplier; The invention enables RFID detection and control to be effectively put to use in connection with pusher displays of all kinds, thus greatly expanding the practical utility of RFID inventory management techniques.

For a more complete understanding of the above and other features and advantages of the invention, reference should be made to the following detailed description of preferred embodiments thereof, and to the accompanying drawings.

DESCRIPTION OF PREFERRED EMBODIMENTS

Figure 1:
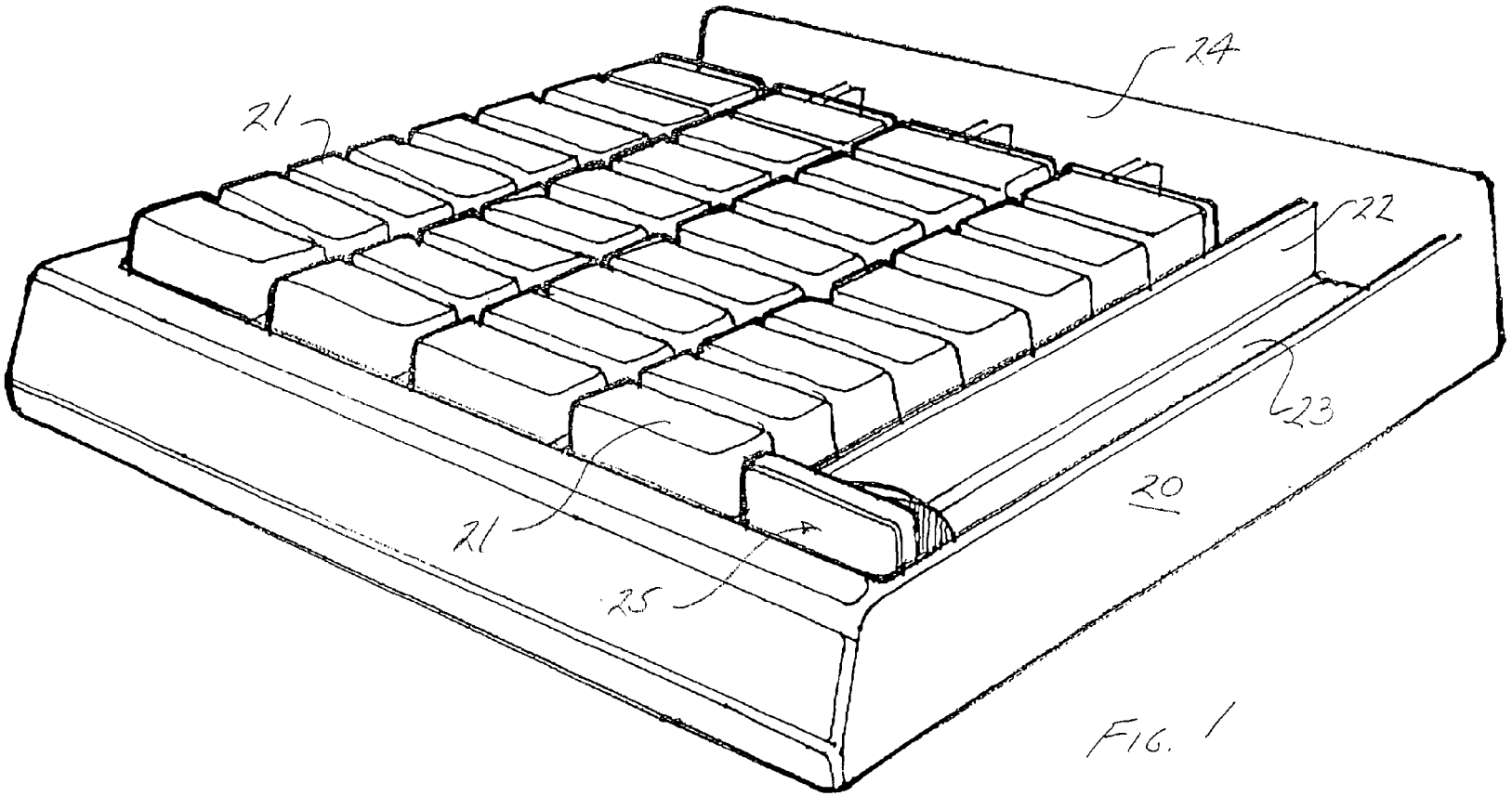
FIG. 1 is a perspective view of a typical tray for the display of small items of merchandise, incorporating features of the invention.

Referring now to the drawing, the reference numeral 20 designates generally a tray for the display of multiple product items 21. The tray includes a plurality of divider walls 22 which form multiple product display channels 23 extending in a front-to-back direction within the tray. The tray can be placed upon a shelf (not shown) or secured by its back wall 24 to a vertical display wall (not shown) at the election of the merchandiser.

Each of the product channels 23 of the tray is provided with a pusher sled 25, which will be described in more detail, which slides in the channel and constantly urges the column of product items 21 to the front of the channel.

Figure 2:
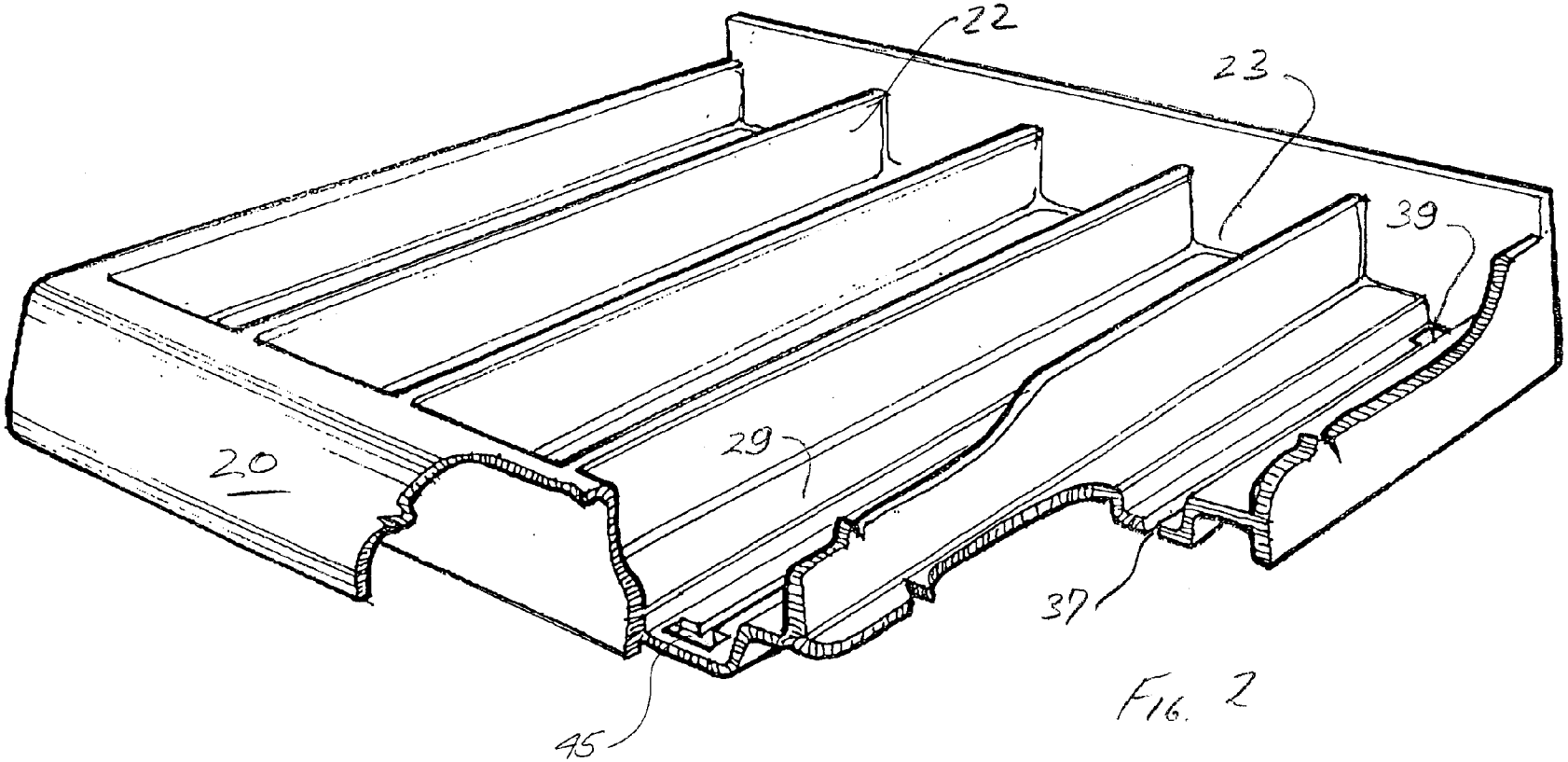
FIG. 2 is a perspective view, similar to FIG. 1, with parts broken away and with product items removed for illustration of structural features.
Figure 10:
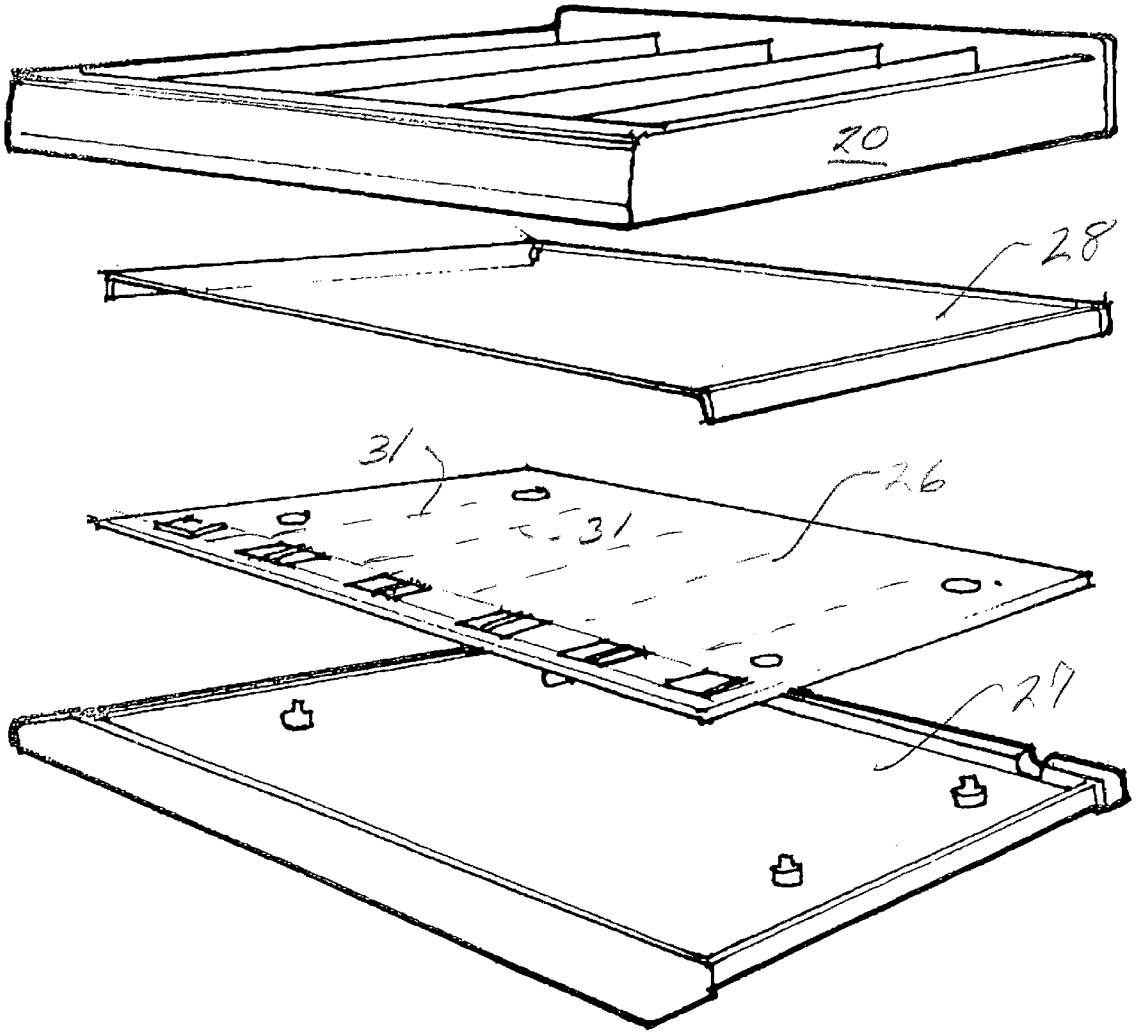
FIG. 10 is an exploded view illustrating the display tray of FIG. 1 in conjunction with RFID reader components associated therewith.

In the system of the invention, the tray 20 is associated with an RFID reader board 26 (FIG. 10), which is mounted on a support panel 27 and provided with a plastic cover 28. The support 27, plastic cover 28 and RFID reader board 26 form a subassembly which is attached to the bottom of the display tray 20, so as to place the reader board 26 in close proximity to the bottom wall 29 of the tray (see FIG. 2).

Figure 11:
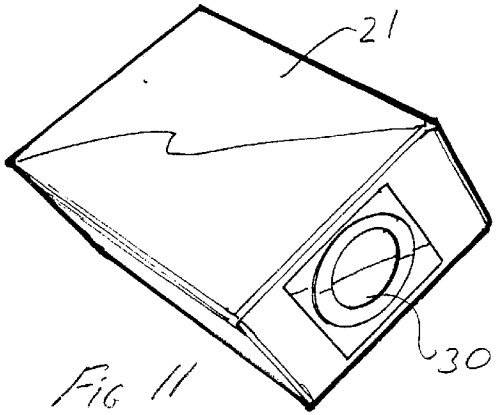
FIG. 11 is a bottom perspective view of one of the product items of FIG. 1, illustrating an RFID identification tag associated therewith.

The RFID reader board 26 is based upon known technology and does not per se form part of this invention. By way of example only, the Doty U.S. Pat. No. 5,591,951 illustrates a type of RFID system for reading encoded information embedded in an identification tag attached to items of merchandise. Systems of this nature are well known and used for a number of purposes. Individual identification tags 30 (FIG. 11), are affixed to each product item 21. The identification tags incorporate circuitry that is activated by radio frequency signals generated by the reader board 26. In response to such activation, the identification tag transmits an identifying signal that is specific to the information embedded in the tag, which signal is received and processed by the reader board, all in accordance with generally known technology. It is within the contemplation of this invention that each product package will be provided with a unique identification tag 30 such that even identical product items, which might bear the same bar code identification, for example, will carry unique identifying information on the RFID tag 30, such that the individual product items can be identified. By means not illustrated herein, but well known in the art, the information read by the reader board 26 can be transmitted to one or more remote locations for processing, such that the exact state of the merchandised carried by the tray 20 can be determined at any time. In the illustrated system, it is contemplated that the reader board 26 will scan the entire tray at, for example, 30 second intervals, so that real time inventory conditions are available to the merchandiser.

Preferably, the reader board 26 is set up with separate reader circuits 31 for each of the channels 23 of the tray 20, enabling the channels to be read individually.

Ideally, a product display tray, such as shown in FIG. 1, incorporates pusher sleds 25 to keep moving the product columns forwardly as individual items are removed by customers. Heretofore, this has presented a serious obstacle to the use of RFID inventory control techniques because of the presence, in a typical pusher sled installation, of a metal strip coil spring associated with the sled and extending from the front of the tray channel 23 rearwardly to the sled, underneath all of the product items 21 in the channel. The presence of this metal strip interferes seriously with the accurate reading of the identification tags 30 by means of a reader board positioned underneath the tray, because the metal strip is interposed directly between the reader 26 and the identification tag 30.

Pursuant to the invention, the above-described problem is obviated by providing a non-metallic tension element, which underlies the product items 21 and connects the pusher sled to the front of the tray. A spring-actuated windup reel is mounted at the back of the sled, such that a metallic spring associated therewith is positioned behind all of the product items of a column and does not interfere with reading of the individual identification tags 30.

A particularly advantageous form of pusher sled utilized in the system of the invention is shown in FIGS. 4–10. The sled 25 is a molded plastic part comprising a front or pusher wall 35 and a bottom wall 36. The sled is of a width appropriate to fit into the individual tray channels 23 for easy front and back sliding movement therein. The several tray channels 23 are provided with longitudinal slots 37 which engage a slide key 38 extending downward from the sled bottom 36. An enlarged opening 39 is provided at the back of the channel to receive a cross bar portion 40 of the slide key 38 during initial assembly of the sled with the tray channel.

Figure 3:
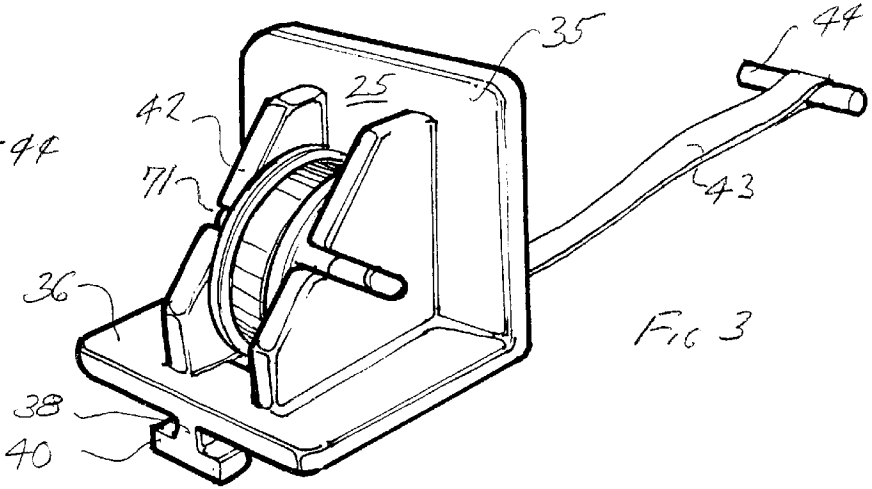
FIG. 3 is a perspective view of an advantageous form of pusher sled, incorporating features of the invention, utilized in the tray of FIG. 1.
Figure 4:
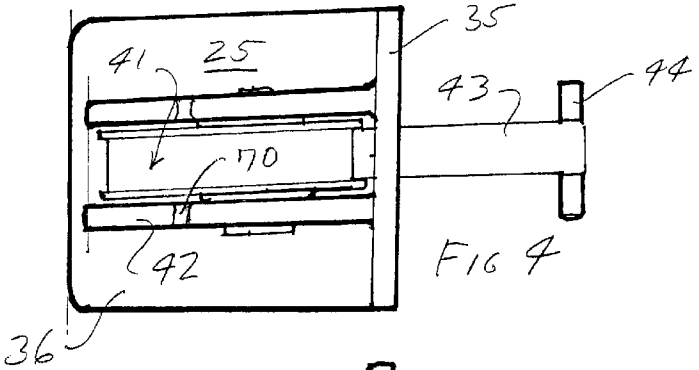
FIGS. 4 and 5 are top plan and side elevational views respectively of the pusher sled of FIG. 3.
Figure 5:
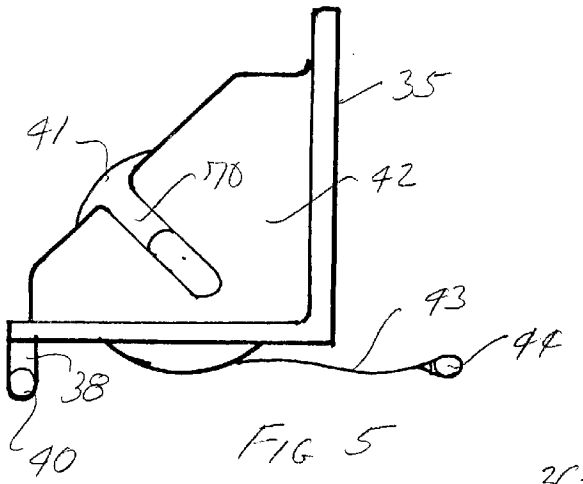

As illustrated in FIGS. 3–5, a windup reel 41 is mounted in the sled, by means of spaced-apart walls 42. The windup reel, to be described in more detail, carries a tension element 43 formed of a non-metallic, flexible material, such as nylon tape. At its forward end, the tension element 43 carries a transverse toggle element 44 which can be received in a transverse slot 45 at the front of the tray channel 23, to serve as an anchor attachment for the front of the tension element 43. The sled 25 is mounted in the channel 23 by initially positioning the sled at the back of the channel and inserting the slide key 38 into the enlarged opening 39. The sled is then moved forward, such that the cross bar 40 is out of alignment with the opening 39, which locks the sled in the channel for front and back sliding movements. The toggle 44 is then inserted into the slot 45 at the front of the channel.

The windup reel 41 is spring driven to constantly urge the tension element 43 toward the reel, such that the sled is always urged forwardly in the channel, urging any product items positioned in the channel toward the front of the tray.

Figure 6:
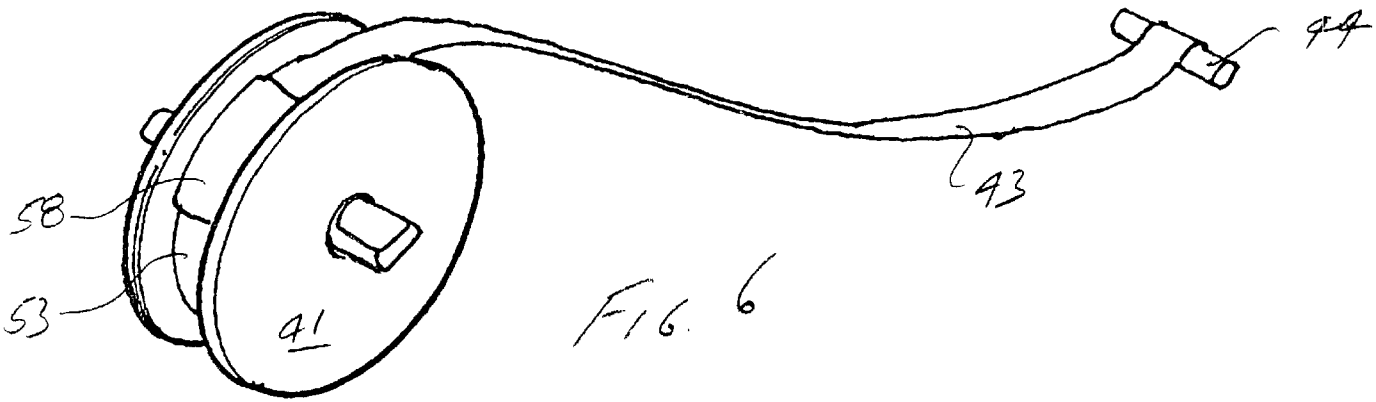
FIG. 6 is a perspective view of a tension element and reel forming part of the mechanism for moving the sled of FIG. 3.
Figure 7:
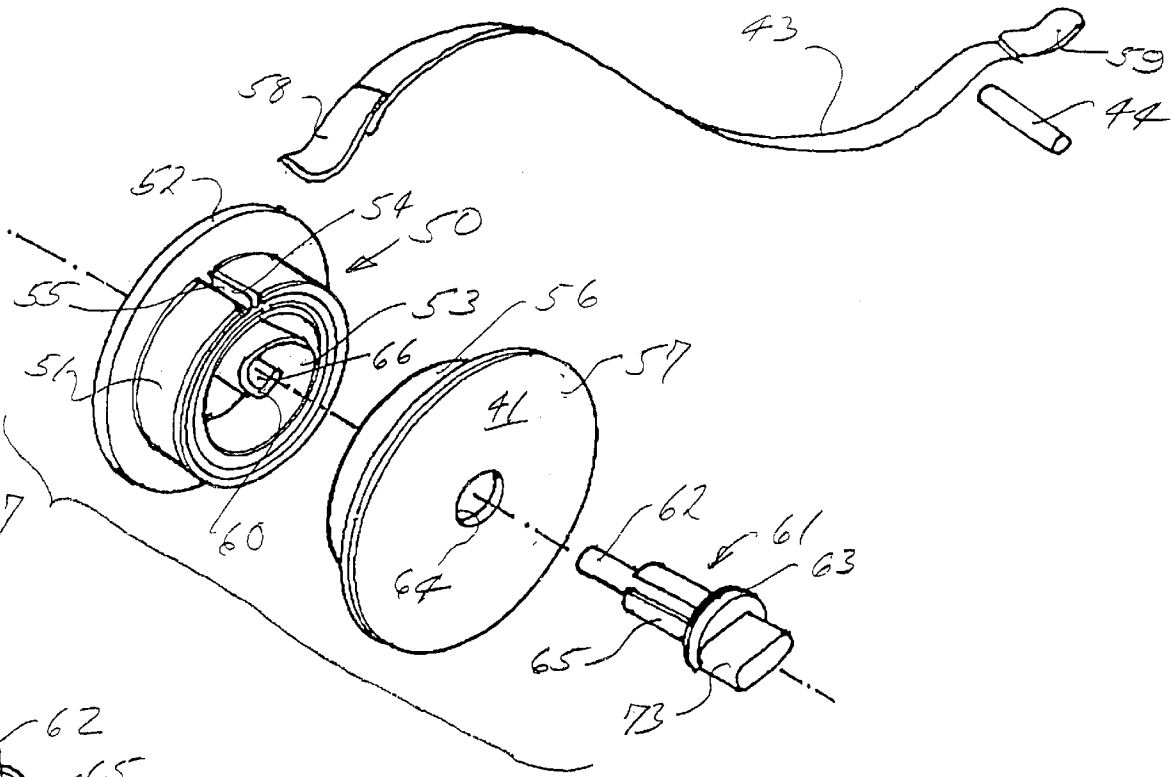
FIG. 7 is an exploded view illustrating the various elements forming the tension element and reel of FIG. 6.
Figure 8:
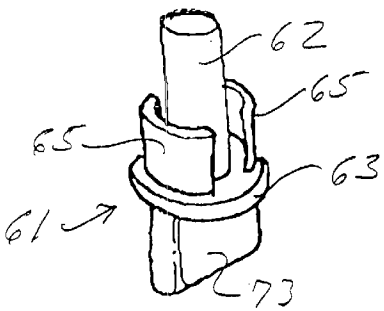
FIG. 8 is an enlarged perspective view of an advantageous form of axle pin which includes means for anchoring a windup spring.

Referring now to FIGS. 6–8, an advantageous form of the windup reel comprises a two-part assembly. One of the parts 50 comprises a cylindrical drum 51 and circular side flange 52. The drum 51 serves as a housing for a coiled strip spring 53 which fits snugly inside the drum 51 and typically tends to expand outwardly against walls of the drum. The outer end extremity 54 of the spring is bent outward and is received in a locking slot 55 in the wall of the drum 51.

The second part of the two-part reel assembly comprises a cylindrical drum 56 and an outer circular flange 57. The drum 56 is received telescopically over the outside of the drum 51 of the other half with a snug fit. No fasteners are required, as the windup reel 41 is confined between the walls 42 of the pusher sled. When the two halves of the assembly are joined, as shown in FIG. 6, the tension element 43 can be secured to the outer surface of the outer cylindrical drum 56, by means of a section of adhesive tape 58. In a similar manner, the toggle element 44 can be joined to the outer end of the tension element by means of a short section 59 of adhesive tape.

In the form of the invention illustrated in FIGS. 6–8, the inner convolution 60 of the spring 53 is engaged by an axle element 61, shown in FIG. 8. The axle element is inserted into the windup reel from one side, and a projecting shaft portion 62 thereof extends entirely through the assembly, and through an opening (not shown) in the circular flange 52, which opening closely fits around the shaft projection 62. The shaft section 62 joins with a cylindrical bearing portion 63, which is of a diameter corresponding to that of an opening 64 in the circular flange 57 of the windup reel. A pair of opposed spring-engaging cleats 65 extend axially from the bearing 63, in spaced relation to the shaft 62. When the axle 61 is inserted into the assembled windup reel, the projecting shaft 62 passes through a bight 66 formed by the inner convolution of the spring 53, and the end of the spring is received in the space between the shaft 62 and the cleats 65. This locks the inner convolution of the spring against rotational movement relative to the axle 61.

When the axle 61 is inserted into the assembled windup reel, the projecting ends of the cleats 65 engage the opposite flange wall 52 and serve as a position stop for the axle, allowing the shaft 62 to project an appropriate distance beyond the flange 52 and positioning the bearing 63 properly within the flange opening 64.

As shown in FIGS. 3 and 5, the spaced walls 42 of the sled are formed with upwardly opening slots 70, 71 angled rearwardly of the front wall 35 of the sled. The slot 71 receives a projecting end of the shaft 62, while the slot 70 receives a key 73 which projects outward from the bearing 63. When the shaft 61 is in place, the assembly of the windup reel and shaft can simply be inserted into the slots 70, 71, to mount the reel on the sled. The spring 53 can be pretensioned as desired by rotating the axle 61 before inserting the key 73 into the slot 70.

As shown in FIG. 5, the lower portion of the windup reel 41 projects through the bottom wall 36 of the pusher sled, allowing the tension element 43 to extend forwardly, underneath any product items 21 positioned in a channel 23.

In the operation of the system of the invention, the display tray 20, shown in FIG. 1, is loaded with product items in the individual channels 23, with each channel having a pusher sled 25 bearing upon the rearmost item 21, urging the entire column forward. The RFID reader board 26, which is located directly underneath the tray 20, is activated periodically to read successively the individual columns of product items and report the identity of each individual item present. This enables the merchandiser to ascertain which items are selling and at what rate. Moreover, since each item is individually identified, the data feedback can indicate whether a given item is placed in the wrong column, so that the matter can be quickly corrected.

The non-metallic tension element 43, which is interposed between the bottoms of the product items 21 and the reader board 26 positioned immediately below, does not in any way interfere with the transfer of information to the RFID reader. Although the windup reels 41 are driven by metallic springs 53, these springs are positioned entirely behind the column of product items, and thus cannot interfere with accurate readings of product information.

Figure 9:
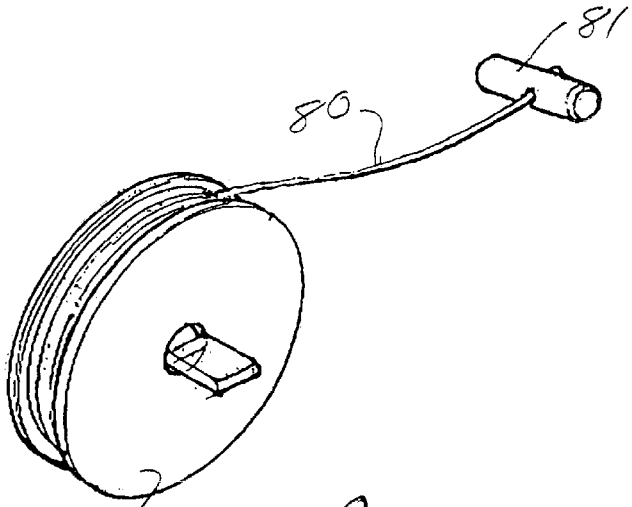
FIG. 9 is a perspective view of an alternative form of tension element, shown with its associated windup reel.

In a modification shown in FIG. 9, the non-metallic tension element 80, is in the form of a plastic monofilament line instead of a non-metallic tape. The monofilament is secured at one end to the windup reel 41 and attached at its free end to a toggle 81. The operation of the windup mechanism and sled of FIG. 9 is the same as previously described.

Figures 12, 13, 14:
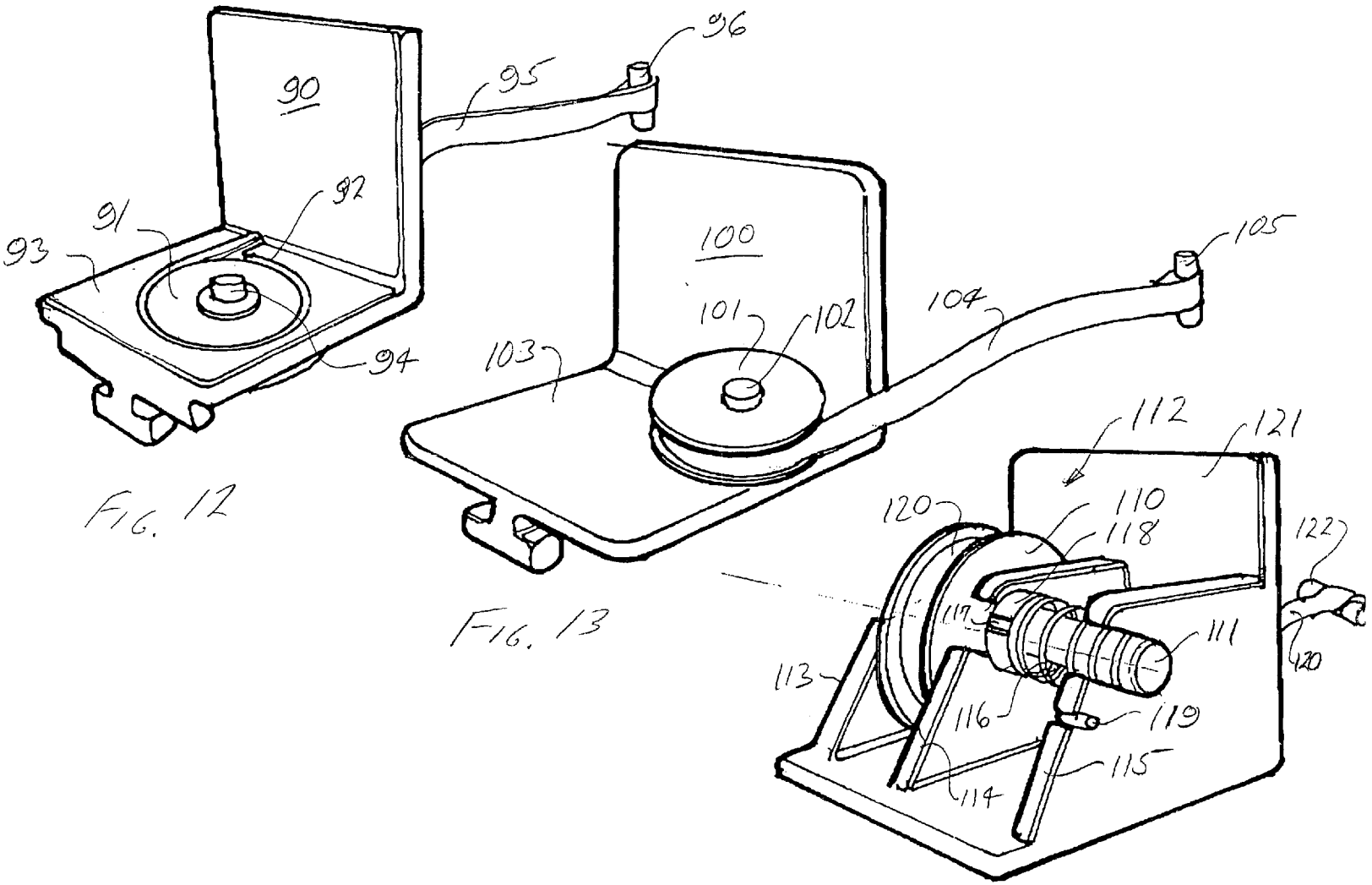
FIGS. 12, 13 and 14 are perspective views of first, second and third alternative forms respectively of pusher sleds that can be usefully employed in the system of the invention.

In the alternative form of pusher sled 90, shown in FIG. 12, a windup reel 91, which can be constructed in a manner similar to the windup reel 41 heretofore described, is mounted in a recess 92 in the bottom wall 93 of the sled. An axle element 94 has its lower end (not shown) fixed in the bottom wall of the sled and serves the function of the axle 61 heretofore described, in locking an inner end convolution of an internal spring (not shown). A non-metallic tape 95 is wound on an outer drum surface of the windup reel 91 and carries a toggle element 96 at its forward end. The toggle element is secured in a forward portion of the display tray. In the case of the embodiment of FIG. 12, the toggle advantageously may be anchored in a vertical wall of the tray. When the non-metallic tape 95 is extended, the windup reel 91 is under spring tension and functions to urge the sled toward the anchored toggle, as will be understood.

In the alternative form of the sled 100, shown in FIG. 13, a windup reel 101 is rotatably mounted on an axle 102 which is non-rotatably mounted on the bottom wall 103 of the sled. The construction of the windup reel 101, and the function of the axle 102, are as previously described, incorporating an internal windup spring tending to retrieve a non-metallic tape 104, which is wound about an outer drum surface of the windup reel. A toggle 105 at the outer end of the tape 104 is arranged to be anchored in a forward portion of the display tray, preferably in a vertical wall thereof.

In the embodiment of FIG. 14, the windup reel 110 is mounted on an axle 111 which rotates with the spring 110. The sled 112 is formed with three vertical walls 113–115 for rotatably supporting the windup reel 110 and its axle 111.

The sled arrangement of FIG. 14 incorporates a helical spring 116, which is external to the windup reel 110. One end 117 of the spring is locked to a collar 118, which is fixed to the shaft 111 and windup reel 110 for rotation therewith. The opposite end 119 of the helical spring is locked to the sled wall 115. A non-metallic tape 120 is fixed to an outer drum surface of the windup reel 110 and extends through an opening (not shown) in the bottom of the sled or in the forward wall 121 of the sled. A toggle 122 at the forward end of the tape 120 is used to anchor the forward end of the tape at the front of the display tray.

As in the case of the other forms of sleds and windup reels, the spring 116 is pretensioned when the windup reel 110 is installed, such that the windup reel tends to fully retract the tape 120 and thus always tends to move the sled to a forwardmost position in the display tray 20.

The present invention provides a unique and advantageous way for the utilization of product pusher sleds, in themselves well known and widely used, to a product display incorporating RFID inventory identification and control. This is accomplished by elimination of a conventional metal strip coil spring, normally used for the activation of product pusher sleds, and providing for activation of the sleds using non-metallic, flexible tension elements, which do not interfere with the necessary RF transmissions.

The arrangement of the invention greatly extends the usefulness of RFID technology in point-of-purchase display applications, which can now be usefully employed in any of the multitude of display presentations in which pushers are utilized or desired to be utilized.

The sled and windup reel arrangements provided by the invention enable the pusher mechanisms to be economically produced and installed, such that significant cost-to-benefit rations can be realized in extending RFID inventory management and control to product displays using product pusher devices.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A system for the display and distribution of multiple product items, wherein the product items bear RFID identification tags, which comprises (a) a display rack comprising a bottom and confining side structure forming a display track for the presentation of a row of product items supported by said bottom, (b) a pusher sled supported for movement in forward and rearward directions within said display track and having a front wall for engagement with a rearmost product item of a row thereof within said display track, (c) a non-metallic tension element engaging said pusher sled for urging said pusher sled forwardly on said display track to advance product items presented therein, (f) an RFID reader positioned in close relation to said display track for actuating identification tags on product items supported by said display track and reading information obtained therefrom.

2. A system according to claim 1, wherein (a) said RFID identification tags are carried on bottoms of said product items, and (b) said non-metallic tension element extends along said display track underneath said identification tags.

3. A system according to claim 1, wherein (a) a spring-driven reel is mounted on said pusher sled, rearwardly of said front wall, (b) said non-metallic tension element is carried by said reel and has a first end portion extending forwardly of said pusher sled and secured adjacent a front of said display track, (c) spring means are attached to said reel and positioned behind said front wall for urging said reel to rotate in a direction to retrieve and wind up said non-metallic tension element and thereby urge said pusher sled to move in a forward direction.

4. A system according to claim 3, wherein (a) said sled includes a front wall and a bottom wall located behind said front wall, and (b) said spring-driven reel is mounted on said bottom wall for rotation about a vertical axis.

5. A system according to claim 3 wherein (a) said spring driven reel is mounted on an axle, (b) a helical spring surrounds said axle and is connected at one end thereof to said reel, and (c) said helical spring is connected at a second end thereof to said sled.

6. A system according to claim 5, wherein (a) said axle is fixed to said sled for rotation therewith.

7. A system according to claim 1, wherein (a) said RFID reader is positioned directly below said display track for reading product items supported on said display track.

8. A system according to claim 1, wherein (a) said display rack comprises a plurality of sets of confining side structures forming a plurality of side-by-side display tracks, (b) each of said display tracks is provided with a pusher sled actuated by a non-metallic tension member extending forwardly therefrom along the respective display track in which said pusher sled is located, and (c) said RFID reader comprises a reader board positioned directly underneath said display rack for reading identification tags on product items in each of the display tracks thereof.

9. A system according to claim 8, wherein (a) a spring-driven reel is mounted on said pusher sled, rearwardly of said front wall, (b) said non-metallic tension element is carried by said reel and has a first end portion extending forwardly of said pusher sled and secured adjacent a front of said display track, and (c) spring means are attached to said reel and positioned behind said front wall for urging said reel to rotate in a direction to retrieve and wind up said non-metallic tension element and thereby urge said pusher sled to move in a forward direction.

10. A system according to claim 9, wherein (a) said spring means comprises a coiled metal strip spring.

11. A system according to claim 9, wherein (a) said spring-driven reel comprises a central, cylindrical drum and confining flanges at opposite ends of said drum, (b) said spring means comprises a coiled strip metal spring confined within said drum and having an outer end thereof engaging said drum, (c) an axle supports said reel for rotation, (d) said axle is fixed in said sled against rotation, and (e) an inner end of said spring is fixed to said axle.

12. A system according to claim 11, wherein (a) said sled is formed with a pair of parallel walls positioned behind and extending at right angles to said front wall, and (b) said walls having a upwardly opening slots therein for the reception and retention of said axle.

13. A system according to claim 1, wherein (a) said non-metallic tension element comprises a non-metallic tape.

14. A system according to claim 1, wherein (a) said non-metallic tension element comprises a length of monofilament plastic.

* * * * *